US007439674B2

(12) United States Patent
Ahn et al.

(10) Patent No.: US 7,439,674 B2
(45) Date of Patent: Oct. 21, 2008

(54) PLASMA DISPLAY PANEL PROVIDED WITH DISCHARGE ELECTRODES ARRANGED WITHIN UPPER AND LOWER BARRIER RIBS ASSEMBLIES

(75) Inventors: Jeong-Chul Ahn, Suwon-si (KR); Eun-Young Jung, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 479 days.

(21) Appl. No.: 11/101,529

(22) Filed: Apr. 8, 2005

(65) Prior Publication Data

US 2005/0225244 A1 Oct. 13, 2005

(30) Foreign Application Priority Data

Apr. 9, 2004 (KR) ..... 10-2004-0024482

(51) Int. Cl.
*H01J 17/49* (2006.01)

(52) U.S. Cl. ..... 313/584; 313/582; 313/586

(58) Field of Classification Search ..... 313/582–587; 315/169.2–169.4; 345/40, 72
See application file for complete search history.

(56) References Cited

U.S. PATENT DOCUMENTS

| | | | | |
|---|---|---|---|---|
| 3,952,221 | A * | 4/1976 | Kamegaya et al. | 313/585 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Mariceli Santiago
(74) *Attorney, Agent, or Firm*—Robert E. Bushnell, Esq.

(57) ABSTRACT

A PDP (plasma display panel) includes: a first substrate; a second substrate arranged opposite to the first substrate; first barrier ribs arranged between the first substrate and the second substrate and formed of a dielectric material; second barrier ribs arranged between the first barrier ribs and the second substrate and formed of a dielectric material, the second barrier ribs partitioning discharge cells together with the first barrier ribs; first discharge electrodes arranged within the first barrier ribs to surround the discharge cells; second discharge electrodes arranged within the second barrier ribs to surround the discharge cells; phosphor layers arranged within the discharge cells; and a discharge gas injected in the discharge cells, in which sides of the first and second barrier ribs form concave portions.

21 Claims, 10 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 6,777,873 | B2 * | 8/2004 | Hashikawa | 313/582 |
| 7,154,224 | B2 * | 12/2006 | Woo et al. | 313/582 |
| 2005/0110408 | A1 * | 5/2005 | Jang et al. | 313/582 |

FOREIGN PATENT DOCUMENTS

| | | | | |
|---|---|---|---|---|
| JP | 2845183 | | | 10/1998 |
| JP | 2917279 | | | 4/1999 |
| JP | 2001-043804 | | | 2/2001 |
| JP | 2001-325888 | | | 11/2001 |
| KR | 2005121847 | A | * | 12/2005 |
| KR | 2006040523 | A | * | 5/2006 |
| KR | 2006064321 | A | * | 6/2006 |
| KR | 2006083067 | A | * | 7/2006 |

* cited by examiner

PLASMA DISPLAY PANEL PROVIDED WITH DISCHARGE ELECTRODES ARRANGED WITHIN UPPER AND LOWER BARRIER RIBS ASSEMBLIES

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 9 Apr. 2004 and there duly assigned Serial No. 10-2004-0024482.

BACKGROUND OF THE INVENTION

1. Field of the Invention

The present invention relates to a plasma display panel having an improved structure.

2. Description of the Related Art

A plasma display panel (PDP) is a slim and light flat panel display that has a large size, high definition and wide viewing angle. Compared with other flat panel displays, the PDP can be simply manufactured in a large size and the PDP is thus considered to be the next-generation large flat panel display.

The PDP is classified into a DC (direct current) type, an AC (alternating current) type, and a hybrid type according to a discharge voltage characteristics. Also, the PDP is classified into an opposite discharge type and a surface discharge type according to a discharge structure.

A conventional triode surface discharge PDP includes a scan electrode, a common electrode, a bus electrode, a dielectric layer covering the electrodes, and an MgO layer, which are disposed on a front substrate. Most (about 40%) visible rays emitted from a phosphor layer are absorbed by the electrodes and the layers, and therefore a luminous efficiency is low.

If the conventional PDP displays the same image for a long time, the phosphor layer is ion sputtered by charged particles of a discharge gas, thus causing a permanent image sticking or burn-in.

Also, since a distance between the scan electrode and an address electrode where an address discharge occurs is large, an address discharge voltage is high. Further, since the scan electrode and the common electrode where a sustain discharge occurs are formed on the same plane, a discharge start voltage is high.

SUMMARY OF THE INVENTION

It is therefore, an object of the present invention to provide a PDP having an improved structure.

It is another object of the present invention to provide a PDP increasing an amount of wall charges during the discharge and improving the luminous efficiency.

It is yet another object of the present invention to provide a PDP including the electrodes driven at a relatively low voltage, resulting in an increase of a luminous efficiency.

It is still another object of the present invention to provide a PDP including the address discharge occurring efficiently and the address discharge voltage decreasing.

It is another object of the present invention to provide a PDP including the discharge surface can be increased and the discharge area can be extended, so that an amount of plasma increases, accommodating driving by a lower voltage.

It is yet another object of the present invention to provide a PDP including achieving the low voltage driving even when a high-concentration gas such as Xe gas is used as the discharge gas, thus improving the luminous efficiency.

It is still another object of the present invention to provide a PDP including the coated areas of the phosphor layers being increased, and accordingly, visible rays generated by the collision of ultraviolet with the phosphor layers during the discharge are increased, resulting in improvement of the brightness.

It is another object of the present invention to provide a PDP having when the same discharge voltage is maintained, the luminous efficiency is increased.

It is yet another object of the present invention to provide a PDP preventing crosstalk between the discharge cells.

It is still another object of the present invention to provide a PDP including preventing portions of the PDP from being damaged due to the collision of the charged particles.

It is another object of the present invention to provide a PDP with the ion sputtering of the phosphor due to the charged particles being prevented and the permanent image sticking or burn-in does not appear when the same image is displayed for a certain period of time.

According to an aspect of the present invention, there is provided a PDP including: a first substrate; a second substrate arranged opposite to the first substrate; first barrier ribs arranged between the first substrate and the second substrate and formed of a dielectric material; second barrier ribs arranged between the first barrier ribs and the second substrate and formed of a dielectric material, the second barrier ribs partitioning discharge cells together with the first barrier ribs; first discharge electrodes arranged within the first barrier ribs to surround the discharge cells; second discharge electrodes arranged within the second barrier ribs to surround the discharge cells; phosphor layers arranged within the discharge cells; and a discharge gas injected in the discharge cells, wherein sides of the first and second barrier ribs form concave portions.

Sides of the first barrier ribs may be inwardly inclined toward the second substrate, and sides of the second barriers may be outwardly inclined toward the second substrate. The first discharge electrodes may be arranged in parallel to the inclined portions of the first barrier ribs, and the second discharge electrode may be arranged in parallel to the inclined portion of the second barrier rib. An angle between the inclined portion of the first barrier rib and the inclined portion of the second barrier rib may be $90° \leqq \text{angle} < 180°$ (angle being greater than or equal to 90 degrees and less than 180 degrees).

The first and second discharge electrodes may be extended in parallel in a direction where address electrodes are intersected.

The PDP may further include a dielectric layer covering the address electrode.

In the PDP of the present invention, since the sides of the first and second barrier ribs form the concave portion, the discharge path becomes close, resulting in decreasing the discharge start voltage. Also, the discharge path is formed up to the outside of the first and second discharge electrodes, so that the discharge is uniformly formed. Thus, the luminous efficiency is improved.

Also, the wall charges are formed up to the outer portion of the second discharge electrode, a distance between the second discharge electrode and the address electrode decreases so that the address discharge voltage decreases, such that the address discharge is efficiently formed.

Also, since there are no electrodes at portions of the first substrate where visible rays emitted from the discharge cell pass, an opening ratio and a transmittance can be remarkably improved.

In addition, since the surface discharge occurs in all sides defining the discharge space, the discharge surface can be greatly extended.

Further, since the discharge is generated at the sides of the discharge cell and then spread toward the central portion of the discharge cell, the entire discharge cell can be efficiently used. Accordingly, the PDP can be driven at a low voltage, such that the luminous efficiency is remarkably improved.

Furthermore, since the PDP can be driven at a low voltage even when the high-concentration Xe gas is used as the discharge gas, the luminous efficiency can be improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
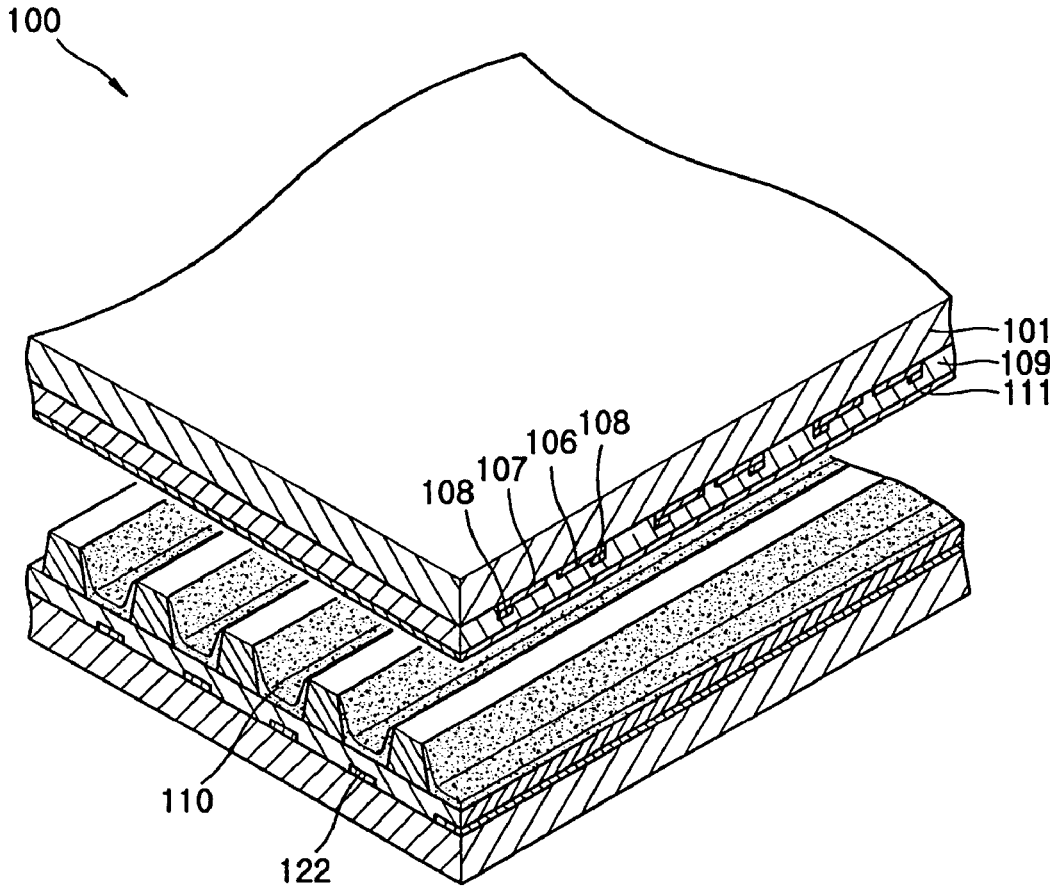
FIG. 1 (CONVENTIONAL ART)
FIG. 1 is a perspective view of a conventional PDP.

Turning now to the drawings, FIG. 1 is an exploded perspective view of a conventional triode surface discharge PDP 100. Referring to FIG. 1, the triode surface discharge PDP includes a scan electrode 106, a common electrode 107, a bus electrode 108, a dielectric layer 109 covering the electrodes, and an MgO layer 111, which are disposed on a front substrate 101. Most (about 40%) visible rays emitted from a phosphor layer 110 are absorbed by the electrodes and the layers, and therefore a luminous efficiency is low.

If the conventional PDP displays the same image for a long time, the phosphor layer 110 is ion sputtered by charged particles of a discharge gas, thus causing a permanent image sticking or image burn-in.

Also, since a distance between the scan electrode 106 and an address electrode 122 where an address discharge occurs is large, an address discharge voltage is high. Further, since the scan electrode and the common electrode where a sustain discharge occurs are formed on the same plane, a discharge start voltage is high.

The present invention will now be described more fully with reference to the accompanying drawings, in which exemplary embodiments of the invention are shown.

First Embodiment

A PDP according to a first embodiment of the present invention will be described in detail with reference to FIGS. 2 through 4.

A PDP 200 includes a first substrate 201, a second substrate 202 disposed in parallel to the first substrate 201, first barrier ribs 208 disposed between the first substrate 201 and the second substrate 202 and formed of a dielectric material, second barrier ribs 211 disposed between the first substrate 201 and the second substrate 202, partitioning discharge cells together with the first barrier ribs 208 and formed of a dielectric material, first discharge electrodes 207 disposed within the first barrier ribs 208 to surround the discharge cells 220, second discharge electrodes 206 disposed within the second barrier ribs 211 to disclose the discharge cells 220, phosphor layers 210 disposed within the discharge cells 220, and a discharge gas (not shown) injected in the discharge cells 220.

In this embodiment, since visible rays generated from the discharge cells 220 are emitted through the first substrate 201 to the outside, the first substrate 201 is formed of material having good transmittance, such as a glass. A front transmittance of visible rays is remarkably improved because the first substrate 201 does not have the scan electrode 106 and the common electrode 107 formed of indium tin oxide (ITO), the bus electrode 108, and the dielectric layer 109 covering the electrodes, which have been formed on a front substrate of a conventional PDP 100. Accordingly, if an image is implemented to have a conventional brightness, the electrodes 106, 107 and 108 are driven at a relatively low voltage, resulting in an increase of a luminous efficiency.

The first barrier ribs 208 and the second barrier ribs 211 partition the discharge cells 220 corresponding to one subpixel among a red subpixel, a green subpixel, and a blue subpixel, and prevent crosstalk between the discharge cells 220.

The first barrier ribs 208 include first central portions 208*b* and first outer portions 208*a* surrounding the first central portions 208*b*. Also, the second barrier ribs 211 include second central portions 211*b* and second outer portions 211*a* surrounding the second central portions 211*b*.

The first barrier ribs 208 and the second barrier ribs 211 prevent the first discharge electrodes 207 and the second discharge electrodes 206 from being directly electrically connected together during a sustain discharge, and prevents charged particles from directly colliding with the electrodes 206 and 207, such that the electrodes 206 and 207 can be protected. The first barrier ribs 208 and the second barrier ribs 211 are formed of dielectric material, such as PbO, $B_2O_3$ and $SiO_2$, which can guide the charged particles to accumulate wall charges. The first central portion 208*b* and the first outer portion 208*a* can be formed of the same material or different materials.

A first inclined portion 291*a*, inwardly inclined toward the second substrate 202, is formed at sides of the first barrier ribs 208, and second inclined portion 291*b* outwardly inclined toward the second substrate 202 is formed at sides of the second barrier ribs 211. Although the first inclined portions 291*a* and the second inclined portions 291*b* are in contact with each other in FIGS. 2 and 3, the present invention is not limited to this structure. That is, the first inclined portions 291*a* and the second inclined portions 291*b* have only to form a concave portion 212 at the sides of the first barrier ribs 208 and the second barrier ribs 211.

Figure 3:
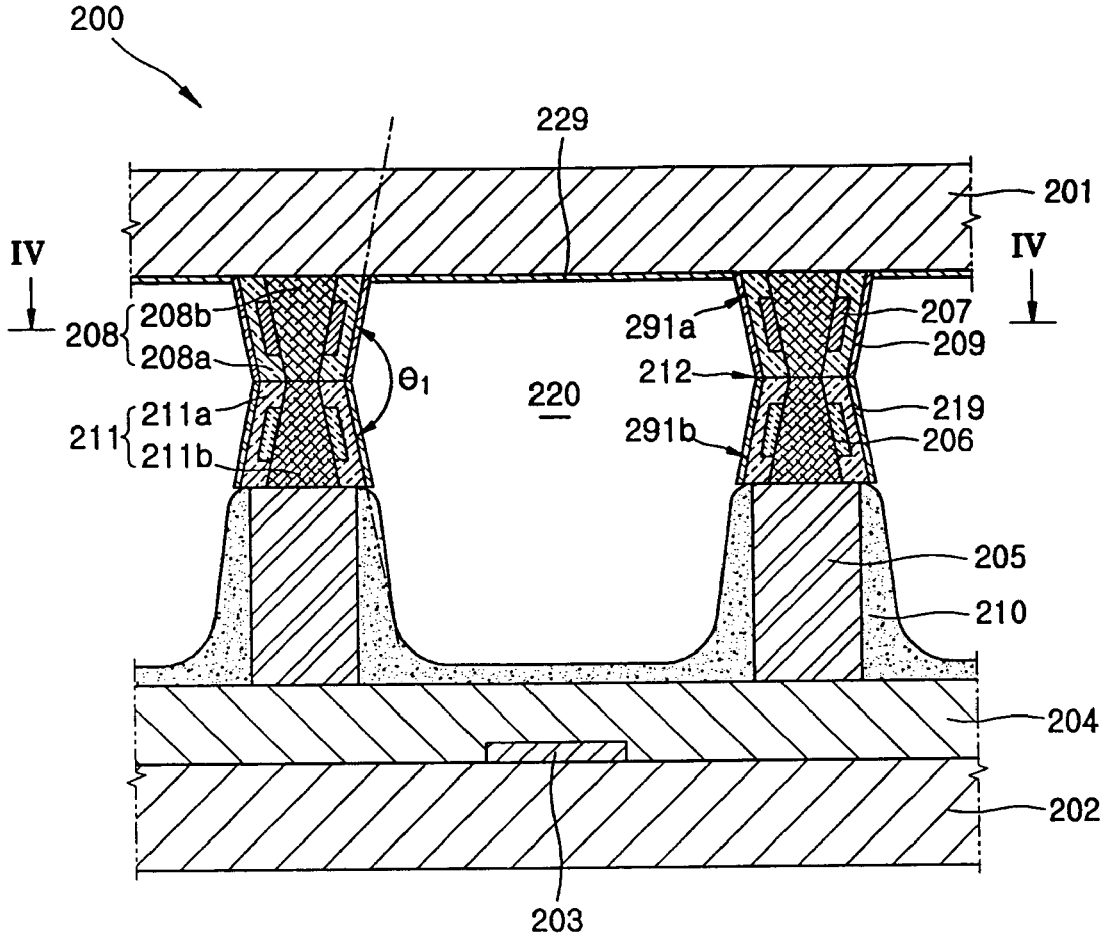
FIG. 3 is a sectional view taken along line III-III of FIG. 2.

Referring to FIG. 3, the first inclined portion 291*a* and the second inclined portion 291*b* are inclined at a predetermined angle. It is preferable that the angle between the first inclined portion 291*a* and the second inclined portion 291*b* is $90° \leqq \theta_1 < 180°$. In such a structure, the discharge efficiently occurs at the first discharge electrode 207 and the second discharge electrode 206, which are respectively disposed within the first barrier ribs 208 and the second barrier ribs 211. The reason is that as the discharge between the discharge electrodes is closer to the opposite discharge, the discharge characteristics between the discharge electrodes are more efficient. Also, at an early time, the discharge starts from a gap between the first discharge electrode 207 and the second discharge electrode 206 and then evolves to spread toward their outer portions. Further, a distance between the wall charges accumulated at the sides of the first barrier ribs 208 and the second barrier ribs 211 becomes closer. Thus, a discharge path becomes short, thereby decreasing the discharge start voltage.

It is preferable that the sides of the first barrier ribs 208 and the second barrier ribs 211 are covered with the MgO layers 209 and 219 serving as a protective layer. Although the MgO layers 209 and 219 are not requisite components, they can prevent the barrier ribs 208 and 211 from being damaged due to the collision of the charged particles with the barrier ribs 208 and 211 formed of a dielectric material. Also, the MgO layers 209 and 219 emit many secondary electrons during the discharge.

The first barrier ribs 208 and the second barrier ribs 211 can be formed separately, but can also be formed in one body. Here, the one body does not mean that the barrier ribs 208 and 211 are formed in the same process, but means that the barrier ribs 208 and 211 are formed not to be separated easily.

Figure 4:
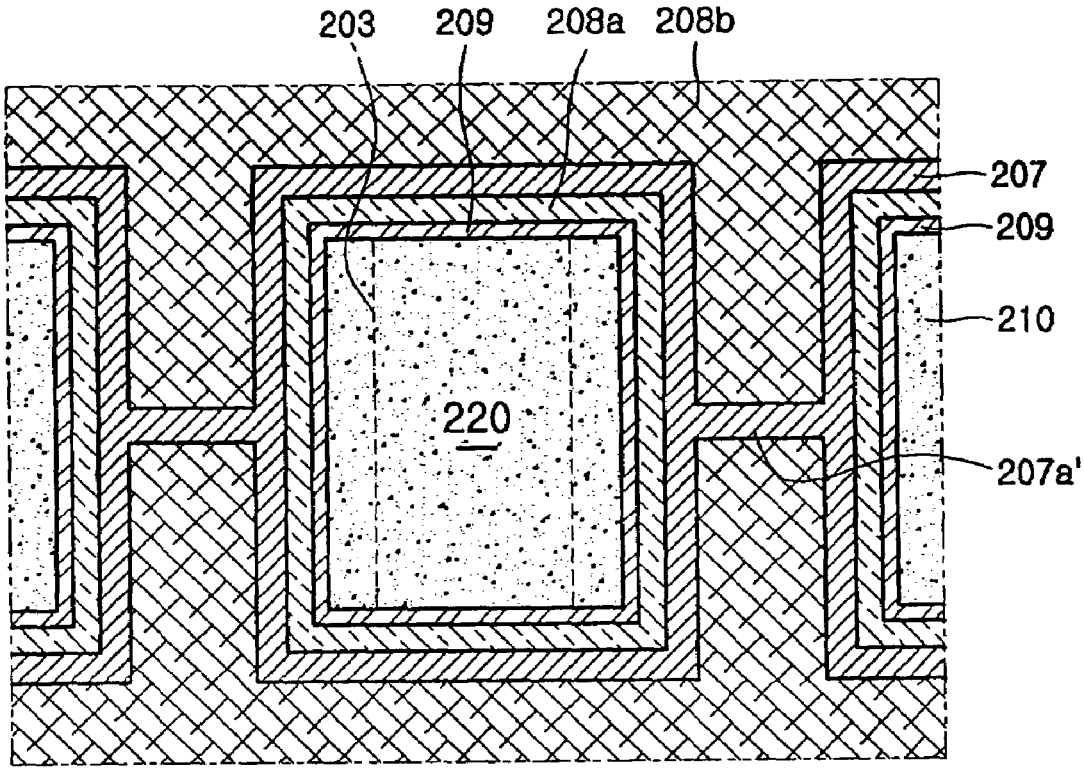
FIG. 4 is a sectional view taken along line IV-IV of FIG. 3.

Referring to FIGS. 3 and 4, the first discharge electrodes 207 surrounding the discharge cells are disposed within the first barrier ribs 208, and the second discharge electrodes 206 surrounding the discharge cells are disposed within the second barrier ribs 211.

The first discharge electrodes 207 and the second discharge electrodes 206 are formed of a conductive metal, such as aluminium and copper. Also, the first discharge electrodes 207 and the second discharge electrodes 206 are spaced apart in a direction perpendicular to the front substrate 201 and extended in parallel to each other.

The first discharge electrodes 207 are disposed in parallel to the first inclined portions 291*a*, and the second discharge electrodes 206 are disposed in parallel to the second inclined portions 291*b*. Accordingly, in addition to the sides of the barrier ribs 208 and 211 where the wall charges are accumulated, the discharge electrodes 207 and 206 are disposed close to each other, resulting in a more efficient discharge.

The PDP can further include third barrier ribs 205 disposed between the second barrier ribs 211 and the second substrates 202. In this case, the phosphor layers 210 are disposed at the same level as the third barrier ribs 205. Although the first through third barrier ribs 208, 211 and 205 partition the discharge cells 220 in a matrix in FIG. 2, the present invention is not limited to this structure. That is, if only a plurality of discharge cells can be formed, the barrier ribs can be formed in various types, for example, open barrier ribs such as a stripe type, and closed barrier ribs such as a waffle, matrix or delta type. Also, in a cross section, the closed barrier ribs can partition the discharge cells to have a cross section as a polygon, such as a rectangular, triangular or pentagonal shape, or a circular or elliptic shape. However, it is preferable that the first barrier ribs and the second barrier ribs partitioning the discharge cells 220 are formed in the same shape. Like in the first embodiment, it is preferable that the first through third barrier ribs 208, 211 and 205 are formed with the same shape, but they can also be formed in different shapes. Further, although the second barrier ribs 211 and the third barrier ribs 205 can be formed separately, it is preferable that they are formed in one body.

The second substrate 202 supports the address electrodes 203 and the dielectric layer 204, and is formed of a material whose main component is glass.

The address electrodes 203 are disposed on the second substrate 202 opposite to the first substrate 201. The address electrodes 203 are disposed in a direction intersecting with the direction where the first and second discharge electrodes 207 and 206 are disposed, and is extended in a direction where the discharge cells 202 of one row are disposed. The address electrode 203 initiates an address discharge to make it easier to initiate a sustain discharge between the first discharge electrode 207 and the second discharge electrode 206. That is, the address electrode 203 reduces a voltage at which the sustain discharge starts. The address discharge occurs between the scan electrode and the address electrode. When the address discharge is finished, positive ions are accumulated on the scan electrode and electrons are accumulated on the common electrode. Thus, the sustain discharge between the scan electrode and the common electrode occurs easier. The second discharge electrode 206 close to the address electrode 203 serves as the scan electrode, and the first discharge electrode 207 serves as the common electrode, since the address discharge occurs efficiently when the gap between the scan electrode and the address electrode is narrower. However, even when there is no address electrode, the discharge can occur between the first discharge electrode and the second discharge electrode. Therefore, the present invention is not limited to the structure having the address electrode. In case where there is no address electrode, the first discharge electrode and the second discharge electrode are extended to intersect with each other.

The dielectric layer 204 where the address electrodes 203 are buried or embedded in, is formed of a dielectric material, such as PbO, $B_2O_3$ and $SiO_2$, which can guide charges and also prevent the damage of the address electrode 203 due to the collision of positive ions or electrons with the address electrodes 203 during the discharge.

As described above, since the sides of the first and second barrier ribs 208 and 211 form the predetermined angle $\theta_1$, the wall charges are accumulated up to the upper and lower surface of the first and second barrier ribs 208 and 211 disposed at the end portions of the first and second discharge electrodes 207 and 206, resulting in increasing the discharge area. Accordingly, the discharge path is also formed at the end portions of the address electrode 203 and the discharge electrodes 207 and 206, such that the address discharge occurs efficiently and the address discharge voltage decreases.

Figure 2:
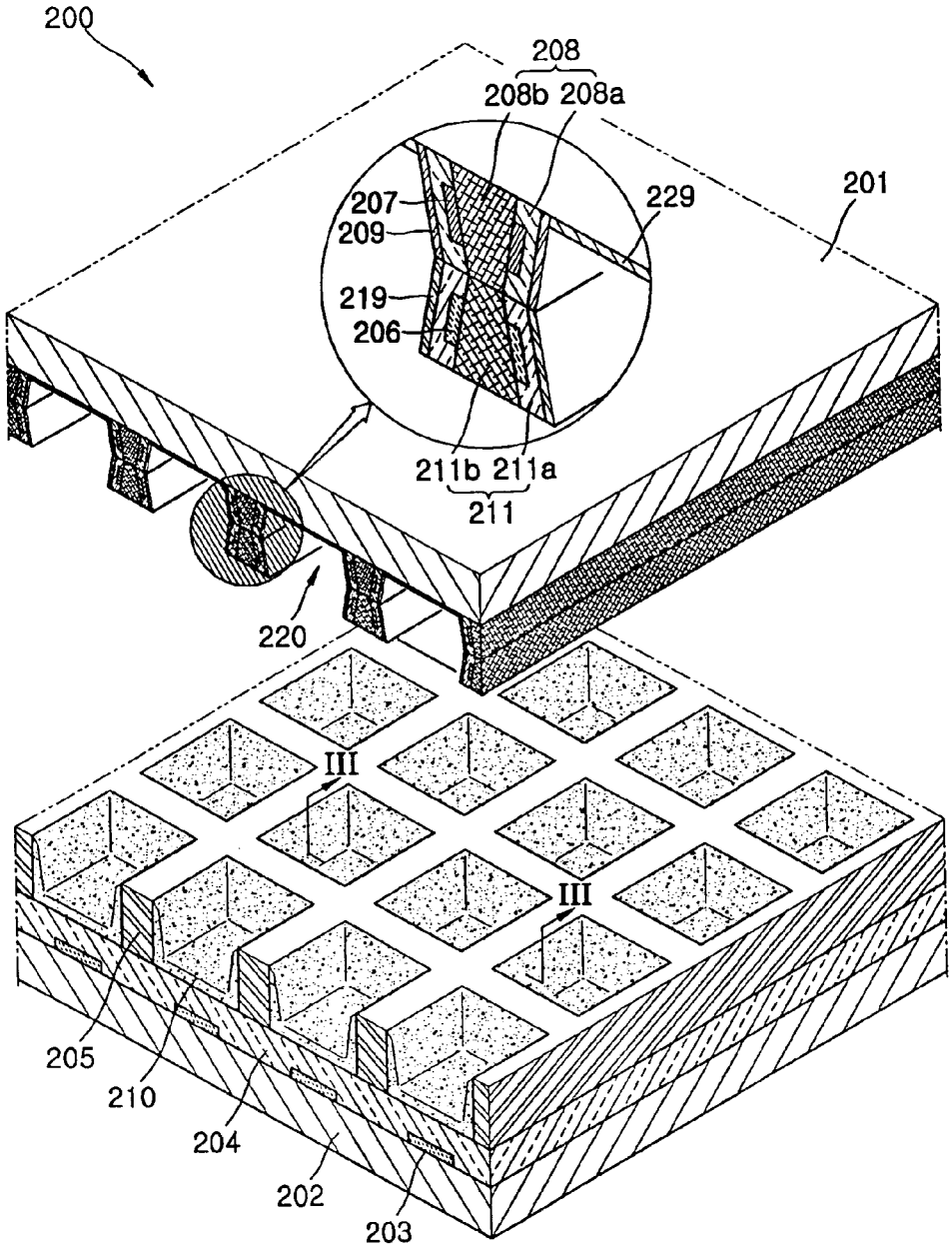
FIG. 2 is an exploded perspective view of a PDP according to a first embodiment of the present invention.

As shown in FIGS. 2 and 3, the phosphor layers 210 are formed on the side of the third barrier ribs 205 and the dielectric layer 204 disposed between the third barrier ribs 205. The phosphor layers 210 contain a component that receives ultraviolet rays generated by the discharge between the first discharge electrode 207 and the second discharge electrode 206 and emits visible rays. The phosphor layers formed at the red subpixel contain a phosphor, such as $Y(V,P)O_4$:Eu; the phosphor layers formed at the green subpixel contain a phosphor, such as $Zn_2SiO_4$:Mn and $YBO_3$:Tb; and the phosphor layer formed at the blue subpixel contains a phosphor, such as BAM:Eu.

The discharge cells 220 are filled with a discharge gas, such as Ne, Xe and a mixed gas thereof. According to the present invention, the discharge surface can be increased and the discharge area can be extended, so that an amount of plasma increases. Therefore, a low voltage driving is possible. Since the present invention can achieve the low voltage driving even when a high-concentration Xe gas is used as the discharge gas, the luminous efficiency can be remarkably improved. Consequently, the present invention can solve the problem of the conventional PDP where the low voltage driving is difficult when the high-concentration Xe gas is used as the discharge gas.

An MgO layer 229 serving as the protective layer is formed on the lower portion of the first substrate 201. Since an operation of the MgO layer 229 is equal as described above, a detailed description thereof will be omitted. Here, the MgO layer 229 is not a requisite component of the present invention.

In the above-described PDP 200, the address discharge is ignited by applying the address voltage between the address electrode 203 and the second discharge electrode 206. As a result of the address discharge, the discharge cell 220 for the sustain discharge is selected.

Thereafter, an AC sustain voltage is applied between the first discharge electrode 207 and the second discharge electrode 206 of the selected discharge cell 220, the sustain discharge occurs therebetween. Due to the sustain discharge, an energy level of the excited discharge gas is lowered and thus ultraviolet rays are emitted. The ultraviolet rays excite the phosphor layer 210 disposed in the discharge cell 220 and the energy level of the excited phosphor layer 210 is lowered to emit the ultraviolet rays, thereby forming an image.

According to the conventional PDP shown in FIG. 1, the sustain discharge between the scan electrode 13 and the common electrode 12 occurs in a horizontal direction, so that the discharge area is relatively narrow. However, according to the present invention, the sustain discharge of the PDP is not limited to the restricted area, so that the discharge area is relatively wide.

Also, the sustain discharge is formed in a closed curve along the side of the discharge cell 220 and is gradually spread toward the central portion of the discharge cell 220. Thus, a volume of an area where the sustain discharge occurs is increased and the space charges in the discharge cell unused in a conventional PDP also attribute to the discharge. This results in the improvement of the luminous efficiency of the PDP.

Further, since the sides of the first barrier ribs 208 and the second barrier ribs 211 form the predetermined angle $\theta_1$, the effect of the opposite discharge can be obtained. Accordingly, the discharge efficiency is improved and the discharge path is reduced, so that the discharge start voltage is decreased.

As shown in FIG. 3, the sustain discharge occurs only in the area limited by the first and second barrier ribs 208 and 211. Therefore, the ion sputtering of the phosphor due to the charged particles can be prevented and the permanent image sticking does not appear when the same image is displayed for a long time.

Figure 5:
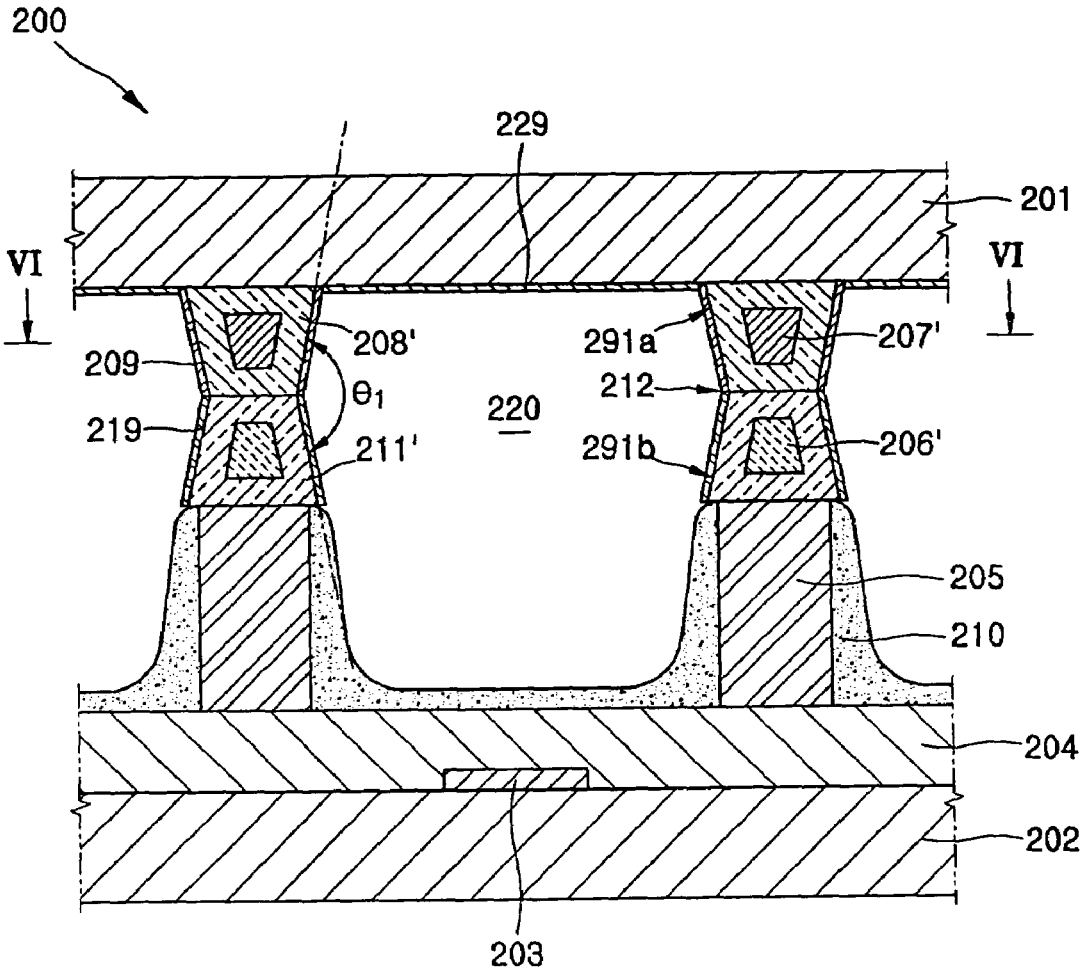
FIG. 5 is a sectional view of a modification of the first embodiment of the present invention.
Figure 6:
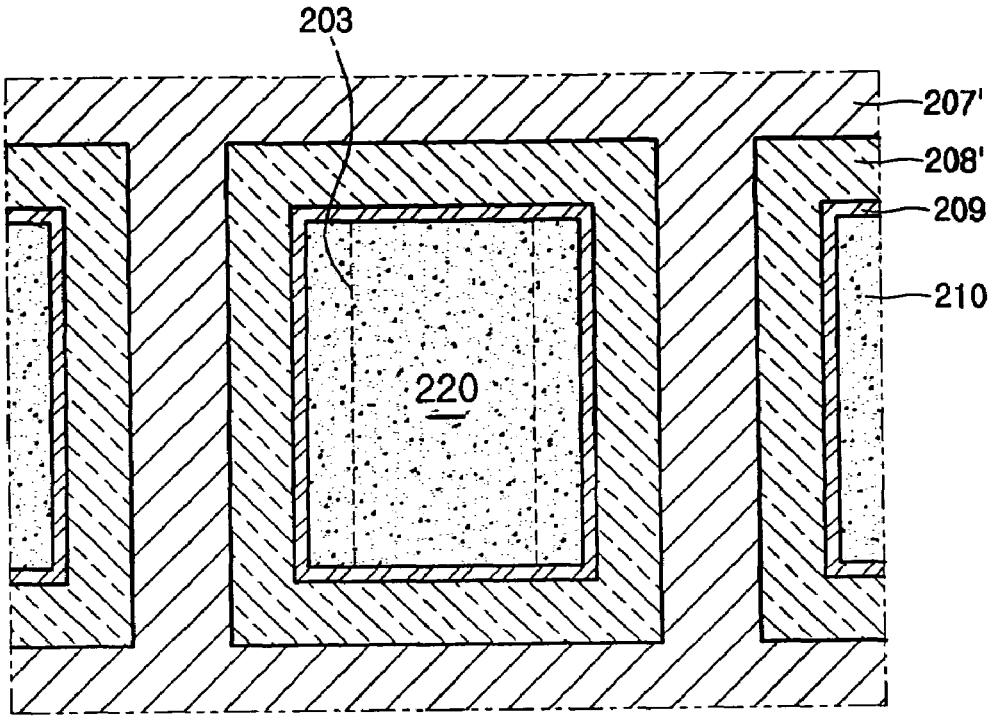
FIG. 6 is a sectional view taken along line VI-VI of FIG. 5.

A modification of the first embodiment will now be described with reference to FIGS. 5 and 6. FIG. 5 is a sectional view of the modification and FIG. 6 is a sectional view taken along line VI-VI of FIG. 5. In the drawings, the same references as the first embodiment denote the components that have structure and function similar to those of the first embodiment.

A difference is that central portions and outer portions of first barrier ribs 208' are formed in one body, not separately. Also, unlike the first embodiment where the first discharge electrodes are separately formed in the rectangular shape at every adjacent discharge cells with symmetry to the central portion 207*a*', first discharge electrodes 207' are formed in a ladder shape. Since second barrier ribs 211' and second discharge electrodes 206' disposed within the second barrier ribs 211' are formed in a shape similar to the first barrier ribs 208' and the first discharge electrodes 207, a detailed description thereof will be omitted.

According to the PDP 200 having the above structure, the discharge electrodes 207' and 206' and the barrier ribs 211' and 208' can be easily formed. Therefore, a manufacturing cost is reduced and a manufacturing cost is simplified.

Second Embodiment

Figure 7:
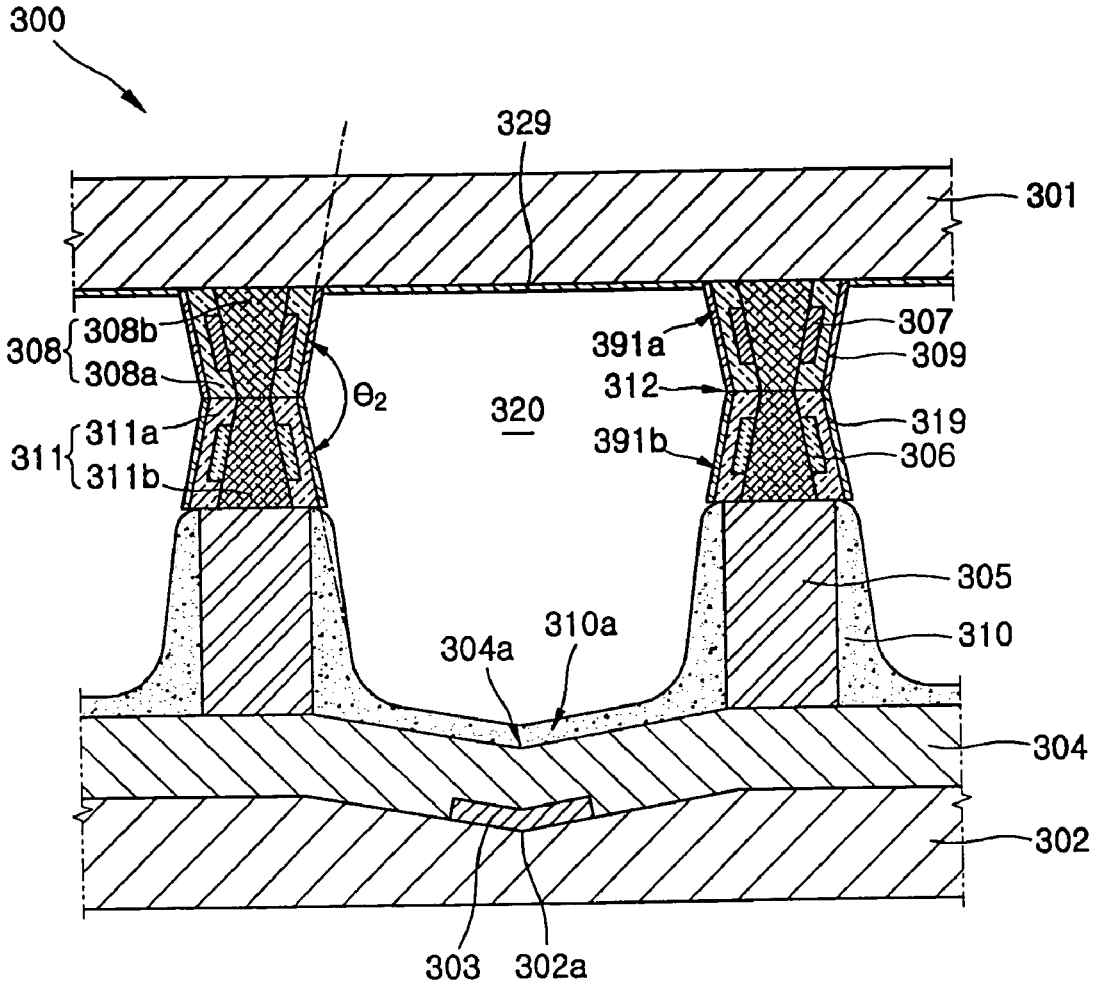
FIG. 7 is a sectional view of a PDP according to a second embodiment of the present invention.

A PDP according to a second embodiment of the present invention will be described in detail with reference to FIG. 7.

A PDP 300 includes a first substrate 301, a second substrate 302 disposed in parallel to the first substrate 301, first barrier ribs 308 disposed between the first substrate 301 and the second substrate 302 and formed of a dielectric material, second barrier ribs 311 disposed between the first substrate 301 and the second substrate 302, separating discharge cells together with the first barrier ribs 308 and formed of a dielectric material, first discharge electrodes 307 disposed within the first barrier ribs 308 to surround the discharge cells 320, second discharge electrodes 306 disposed within the second barrier ribs 311 to disclose the discharge cells 320, third barrier ribs 305 disposed between the second barrier ribs 311 and the second substrate 302, phosphor layers 310 disposed within a space defined by the third barrier ribs 305, and a discharge gas (not shown) injected in the discharge cells 320.

Since structures and operations of the first substrate 301, protective layers 309, 319 and 329, the first barrier ribs 308 having first central portions 308*b* and first outer portions 308*a*, the second barrier ribs 311 having second central portions 311*b* and second outer portions 311*a*, the first discharge electrodes 307, the second discharge electrodes 306 and the third barrier ribs 305 are equal or similar to those of the first embodiment, a description thereof will be omitted.

First inclined portions 391*a* inwardly inclined toward the second substrate 302 is formed at sides of the first barrier ribs 308, and second inclined portions 391*b* outwardly inclined toward the second substrate 302 is formed at a side of the second barrier ribs 311. Although the first inclined portions 391*a* and the second inclined portions 391*b* are in contact with each other in FIG. 7, the present invention is not limited to this structure. That is, the first inclined portions 391*a* and the second inclined portions 391*b* form concave portions 312 at the sides of the first barrier ribs 308 and the second barrier ribs 311.

The first inclined portion 391*a* and the second inclined portion 391*b* form a predetermined angle. It is preferable that the angle between the first inclined portion 391*a* and the second inclined portion 391*b* is $90° \leqq \theta_2 < 180°$. According to the PDP 300 having the above structure, the discharge start voltage is reduced and the discharge efficiency is improved.

A difference from the first embodiment is that a cross-section 302*a* of the second substrate 302 has concaved portions. Also, a cross-section of the address electrodes 303 on the second substrate 302 has bent portions. The address electrodes 303 are extended in one direction, intersecting with the first and second discharge electrodes 307 and 306. In the dielectric layer 304 covering the address electrode 303, upper portions between the third barrier ribs 305 have a cross-section 304 of a concave shape 304*a*, like a V-shape.

The phosphor layers 310 are formed at the dielectric layer 304 between the third barrier ribs 305 and the side of the third barrier ribs 305. Since the dielectric layers 304 are formed in the concave shape, the coated areas of the phosphor layers 310 are increased. Accordingly, visible rays generated by the collision of ultraviolet with the phosphor layers during the discharge are increased, resulting in improvement of the brightness. Consequently, even when the same discharge voltage is maintained, the luminous efficiency is increased.

Also, since the dielectric layer 304 is formed in the concave shape, the address discharge with the second discharge electrode 306 opposite to the concave portion 304*a* is efficiently performed. That is, the discharge path is formed between an outer portion of the address electrode 303 and the second discharge electrode 306, so that the discharge path and the distribution of the wall charges are uniform over the entire area of the address electrode 303. Thus, the discharge path between the address electrode 303 and the second discharge electrode serving as the scan electrode is reduced, so that the address discharge is easily performed and the discharge voltage is reduced.

Since the driving method of the second embodiment is similar to that of the first embodiment, a detailed description thereof will be omitted.

Third Embodiment

Figure 8:
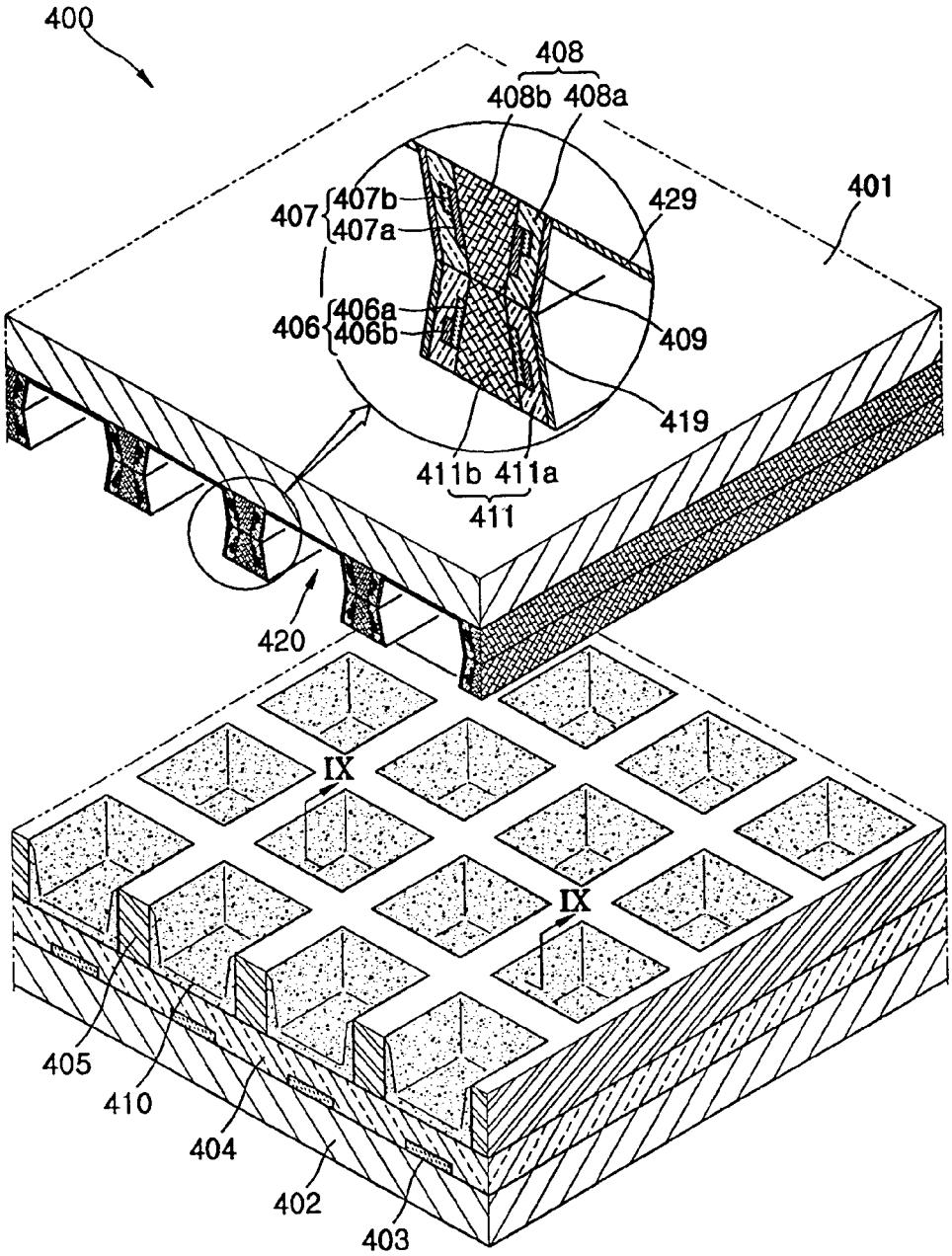
FIG. 8 is an exploded perspective view of a PDP according to a third embodiment of the present invention.
Figure 9:
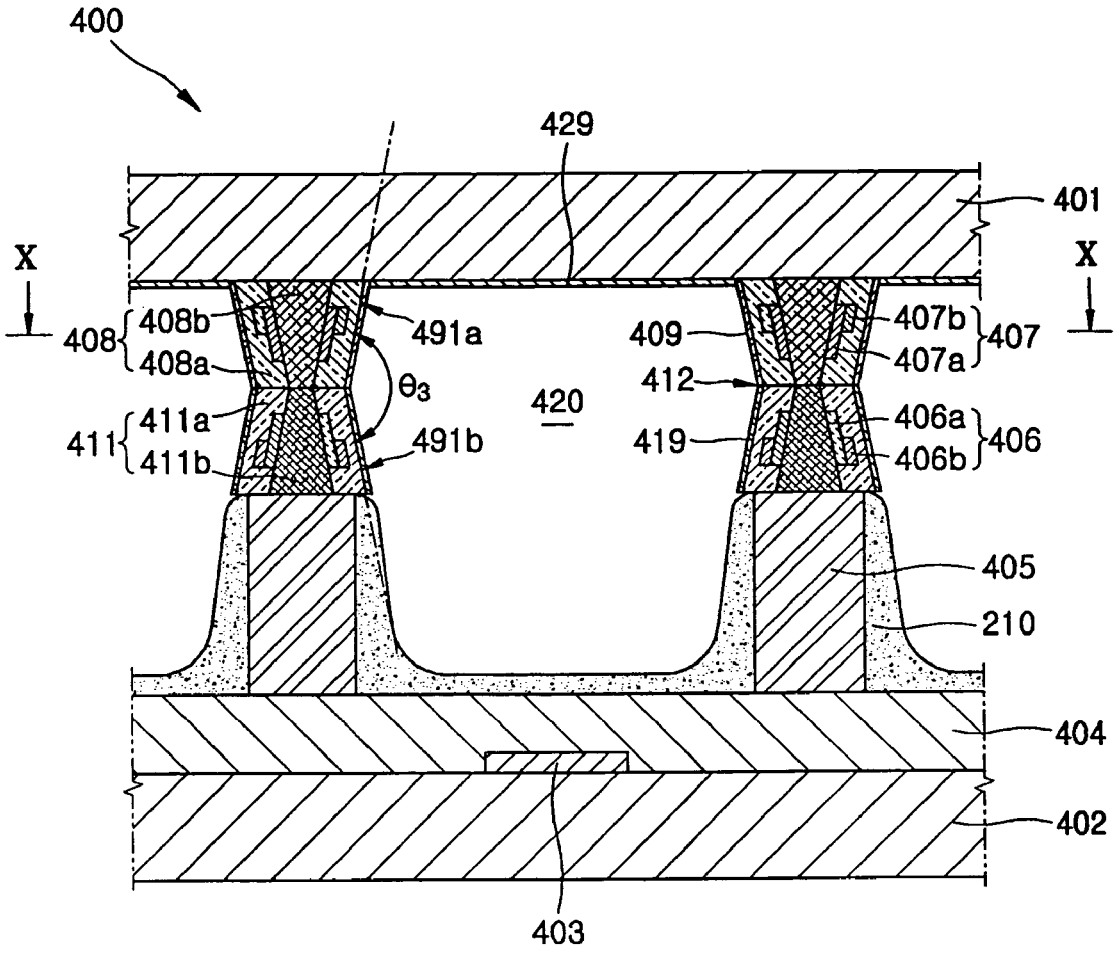
FIG. 9 is a sectional view taken along line IX-IX of FIG. 8.
Figure 10:
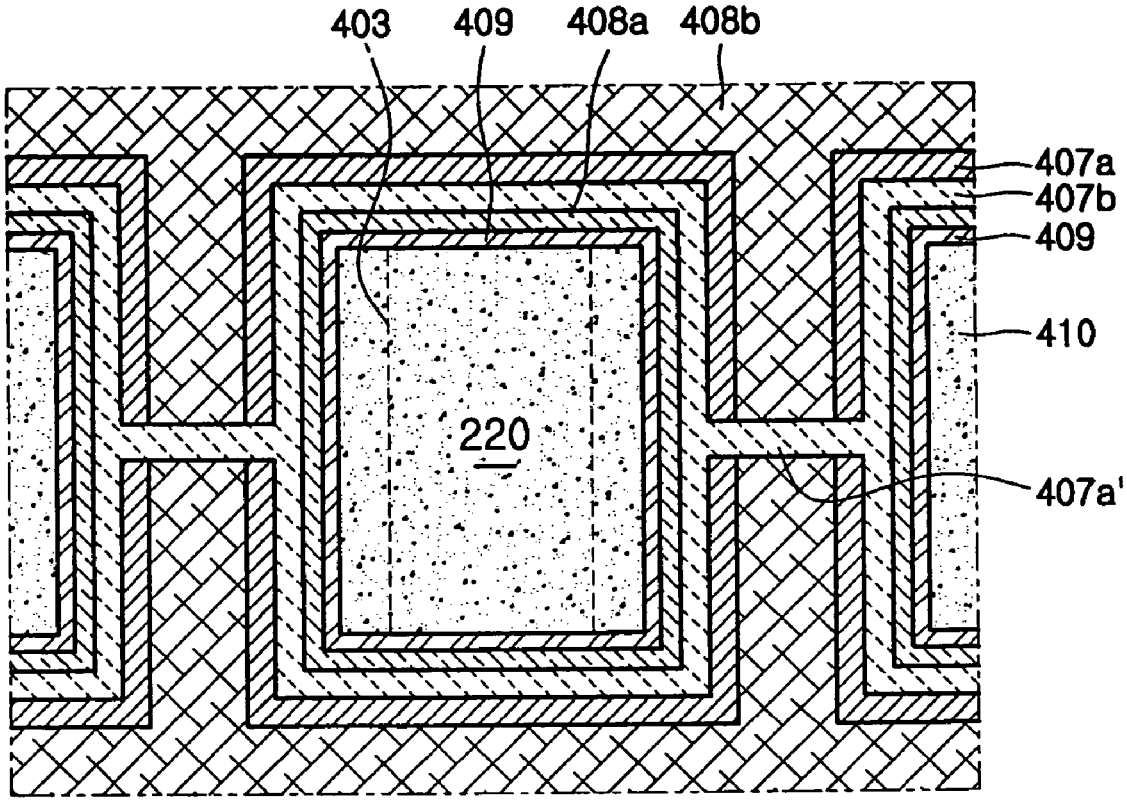
FIG. 10 is a sectional view taken along line X-X of FIG. 9.

A PDP according to a third embodiment of the present invention will be described in detail with reference to FIGS. 8 through 10.

A PDP 400 includes a first substrate 401, a second substrate 402 disposed in parallel to the first substrate 401, first barrier ribs 408 disposed between the first substrate 401 and the second substrate 402 and formed of a dielectric material, second barrier ribs 411 disposed between the first barrier ribs 408 and the second substrate 402, separating discharge cells together with the first barrier ribs 408 and formed of a dielectric material, first discharge electrodes 407 disposed within the first barrier ribs 408 to surround the discharge cells 420, second discharge electrodes 406 disposed within the second barrier ribs 411 to disclose the discharge cells 420, a third barrier ribs 405 disposed between the second barrier ribs 411 and the second substrate 402, a phosphor layers 410 disposed within a space defined by the third barrier ribs 405, and a discharge gas (not shown) injected in the discharge cells 420.

Since structures and operations of the first substrate 401, protective layers 409, 419 and 429, the first barrier ribs 408 having a first central portions 408*b* and first outer portions 408*a*, the second barrier ribs 411 having second central portions 411*b* and second outer portions 411*a*, the third barrier ribs 405, the phosphor layers 410, the dielectric layer 404, the address electrodes 403, and the second substrate 402 are similar to those of the first embodiment, a description thereof will be omitted.

First inclined portions 491*a* inwardly inclined toward the second substrate 402 is formed at sides of the first barrier ribs 408, and second inclined portions 491*b* outwardly inclined toward the second substrate are formed at sides of the second barrier ribs 411. The first inclined portions 491*a* and the second inclined portions 491*b* form concave portions 412 at the sides of the first barrier ribs 408 and the second barrier ribs 411.

The first inclined portions 491*a* and the second inclined portions 491*b* form a predetermined angle. It is preferable that the angle between the first inclined portion 491*a* and the second inclined portion 491*b* is $90° \leqq \theta_3 \leqq 180°$. According to the PDP 400 having the above structure, the discharge start voltage is reduced and the discharge efficiency is improved.

A difference from the first embodiment is that the first discharge electrode 407 includes a discharge unit 407*a* and a bus unit 407*b*, and the second discharge electrode 406 includes a discharge unit 406*a* and a bus unit 406*b*. The discharge units 407*a* and 406*a* and the bus units 407*b* and 406*b* can be arranged in various structures. However, it is preferable that a distance between the bus units 407*b* and 406*b* is larger than that between the discharge units 407*a* and 406*a*. When the bus units 407*b* and 406*b* are arranged far apart from each other, the wall charges can be widely accumulated on the sides of the first and second barrier ribs 408 and 411. Also, due to the discharge units 407*a* and 406*a* arranged close to each other, the distance between the electrodes 407 and 406 decreases so that the discharge start voltage decreases. Further, due to this arrangement of the discharge units 407*a* and 406*a*, the area of the electrode is widened, thereby increasing an amount of wall charges during the discharge and improving the luminous efficiency. The discharge units 407*a* and 406*a* may be a transparent electrode formed of an ITO (Indium Tin Oxide).

Further, the first discharge electrode 407 is formed in parallel to the first inclined portion 491*a*, and the second discharge electrode 406 is formed in parallel to the second inclined portion 491*b*. Since the driving method of the second embodiment is similar to that of the first embodiment, a detailed description thereof will be omitted.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a first substrate;

a second substrate arranged opposite to said first substrate;

first barrier ribs arranged between said first substrate and said second substrate and formed of a dielectric material;

second barrier ribs arranged between said first barrier ribs and said second substrate and formed of a dielectric material, said second barrier ribs partitioning discharge cells together with said first barrier ribs, the sides of said first and second barrier ribs together forming a concave portion;

first discharge electrodes arranged within said first barrier ribs to surround the discharge cells;

second discharge electrodes arranged within said second barrier ribs to surround the discharge cells;

phosphor layers arranged within the discharge cells; and a discharge gas injected into the discharge cells.

2. The plasma display panel of claim 1, wherein sides of said first barrier ribs are inwardly inclined toward the second substrate, and sides of said second barrier ribs are outwardly inclined toward said second substrate to accommodate sides of said first and second barrier ribs forming concave portions.

3. The plasma display panel of claim 2, wherein said first discharge electrodes are arranged parallel to the inclined portions of said first barrier ribs, and said second discharge electrodes are arranged parallel to the inclined portions of said second barrier ribs.

4. The plasma display panel of claim 2, wherein an angle between the inclined portion of each of said first barrier ribs and the inclined portion of each of the second corresponding barrier ribs is less than 180° and greater than or equal to 90°.

5. The plasma display panel of claim 1, wherein said first and second discharge electrodes extend and intersect the direction of the address electrodes.

6. The plasma display panel of claim 5, further comprising a dielectric layer covering said address electrodes.

7. The plasma display panel of claim 6, wherein said dielectric layer and said address electrodes are arranged between said second substrate and said phosphor layers.

8. The plasma display panel of claim 7, wherein an upper portion of said dielectric layer opposite to the discharge cells is formed in a concave shape.

9. The plasma display panel of claim 8, wherein the upper portion of said dielectric layer has a V shaped cross-section.

10. The plasma display panel of claim 1, wherein the sides of said first and second barrier ribs are covered with a protective layer.

11. The plasma display panel of claim 1, wherein a lower portion of said first substrate is covered with a protective layer.

12. The plasma display panel of claim 1, wherein said first barrier ribs and the second barrier ribs are formed in one body.

13. The plasma display panel of claim 1, further comprising third barrier ribs arranged between said second barrier ribs and said second substrate, wherein the phosphor layers are arranged at a same level as said third barrier ribs and on the second substrates.

14. The plasma display panel of claim 13, wherein said second barrier ribs and said third barrier ribs are formed in one body.

15. The plasma display panel of claim 1, wherein said first discharge electrode and the second discharge electrodes are formed of a conductive metal.

16. The plasma display panel of claim 1, wherein each of said first and second discharge electrodes includes a bus unit and a discharge unit.

17. A plasma display panel, comprising:

a first substrate;

a second substrate arranged opposite to said first substrate;

first barrier ribs arranged between said first substrate and said second substrate and formed of a dielectric material;

second barrier ribs arranged between said first barrier ribs and said second substrate and formed of a dielectric material, said second barrier ribs partitioning discharge cells together the sides of the first and second barrier ribs together forming concave portions;

first discharge electrodes arranged within said first barrier ribs encompassing the discharge cells; and second discharge electrodes arranged within said second barrier ribs encompassing the discharge cells, said first barrier ribs and said second barrier ribs preventing the first discharge electrodes and the second discharge electrodes from being directly electrically connected together during a sustain discharge.

18. The plasma display panel of claim 17, wherein:

said first barrier ribs include first central portions and first outer portions surrounding said first central portions and said second barrier ribs include second central portions and second outer portions surrounding said second central portions; and said first barrier ribs including a first inclined portion, inwardly inclined toward said second substrate, and formed at sides of said first barrier ribs, and a second inclined portion outwardly inclined toward said second substrate and formed at sides of said second barrier ribs, said first and second inclined portions accommodating the concave portions at the sides of said first and second barrier ribs.

19. The plasma display panel of claim 17, wherein said second substrate comprises concave portions, and wherein address electrodes on said second substrate have bent portions, wherein said address electrodes extend in one direction, intersecting with said first and second discharge electrodes, a dielectric layer covering said address electrodes arranged between the third barrier ribs, the third barrier ribs arranged between said second barrier ribs and said second substrate, and the dielectric layer includes a concave shape.

20. The plasma display panel of claim 19, wherein both said first and second discharge electrodes comprising a discharge unit and a bus unit, a distance between the bus units of the first and second discharge electrodes being larger than the distance between the discharge units of the first and second discharge electrodes, with said discharge units of said first and second discharge electrodes being adjacent to each other, with said first discharge electrode being formed in parallel to a first inclined portion of said first barrier ribs, and said second discharge electrode being formed in parallel to a second inclined portion of said second barrier ribs, said first and second inclined portions accommodating said concave portions at said first and second barrier ribs.

21. A plasma display panel, comprising:

a first substrate;

a second substrate arranged opposite to said first substrate;

a plurality of first barrier ribs arranged between said first substrate and said second substrate;

a plurality of second barrier ribs arranged between said first barrier ribs and said second substrate and formed of a dielectric material, said second barrier ribs partitioning discharge cells together with said first barrier ribs, the sides of said first and second barrier ribs together forming concave portions, sides of said first barrier ribs being inwardly inclined toward said second substrate, and sides of said second barriers being outwardly inclined toward said second substrate to accommodate sides of said first and second barrier ribs together forming said concave portions;

a plurality of first discharge electrodes arranged within said first barrier ribs to encompass the discharge cells, each one of said first barrier ribs formed in one body embedding said first discharge electrode, the first discharge electrodes separately forming one of a rectangular shape and a ladder shape at adjacent discharge cells with symmetry to a portion of one of said first and second barrier ribs;

a plurality of second discharge electrodes arranged within said second barrier ribs to surround the discharge cells, each one of said second barrier ribs formed in one body embedding said second discharge electrode, said second barrier ribs and second discharge electrodes disposed within said second barrier ribs being formed of the same shape as said first barrier ribs and said first discharge electrodes, each of said first and second discharge electrodes including at least one unit spaced apart a certain distance from each other; and a dielectric layer covering address electrodes between said second substrate and phosphor layers arranged within the discharge cells, said dielectric layer including a flat shape portion or a concave shaped portion, said address electrode including a flat shaped portion or a bent portion.

* * * * *